US006428286B1

(12) United States Patent
Shimizu et al.

(10) Patent No.: US 6,428,286 B1
(45) Date of Patent: Aug. 6, 2002

(54) CAPACITY CONTROL SCROLL COMPRESSOR

(75) Inventors: Akihiko Shimizu, Kusatsu; Masahiko Makino, Shiga; Tatsuhisa Taguchi, Katano; Daisuke Ito, Neyagawa, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/423,824

(22) PCT Filed: May 11, 1998

(86) PCT No.: PCT/JP98/02078

§ 371 (c)(1),
(2), (4) Date: Feb. 14, 1998

(87) PCT Pub. No.: WO98/51930

PCT Pub. Date: Nov. 19, 1998

(30) Foreign Application Priority Data

May 12, 1997 (JP) ..... 9-120632

(51) Int. Cl.[7] ..... F04B 49/24
(52) U.S. Cl. ..... 417/310
(58) Field of Search ..... 417/310

(56) References Cited

U.S. PATENT DOCUMENTS 4,892,466 A 1/1990 Taguchi
5,192,195 A * 3/1993 Iio et al. ..... 417/310
5,356,271 A 10/1994 Miura
5,577,897 A 11/1996 Inagaki et al.
5,639,225 A 6/1997 Matsuda et al.
5,885,063 A * 3/1999 Makino et al. ..... 417/310

FOREIGN PATENT DOCUMENTS

| | | |
|---|---|---|
| DE | 195 19 791 A | 12/1995 |
| EP | 0 555 945 | 8/1993 |
| JP | 56-124696 | 9/1981 |
| JP | 63-212789 | 9/1988 |
| JP | 2-271094 | 11/1990 |
| JP | 3-59493 | 6/1991 |
| JP | 4-179886 | 6/1992 |
| JP | 5-280476 | 10/1993 |
| JP | 9-296787 | 11/1997 |

* cited by examiner

*Primary Examiner*—Michael Koczo
(74) *Attorney, Agent, or Firm*—Amster, Rothstein & Ebenstein

(57) ABSTRACT

A capacity-controlled scroll compressor for reducing a start shock and improving machinability of a fixed end plate, wherein a high pressure Ph to be guided to a control valve (70) for controlling a control pressure Pm for operating a shuttle valve (60) is introduced from a high pressure passage (72) opening at a discharge port **(1*c*) to reduce a start shock. A bypass hole (52*a*) and the high pressure passage (72) are constituted by a straight through-hole extending through a cylinder (61) from the outer peripheral portion of a fixed end plate (1*a*) and consequently, machinability of the fixed end plate (1*a*)** can be improved.

8 Claims, 5 Drawing Sheets

CAPACITY CONTROL SCROLL COMPRESSOR

FIELD OF THE INVENTION

The present invention relates to a capacity control mechanism of a scroll compressor for use in automotive air conditioning apparatus.

BACKGROUND OF THE INVENTION

As a capacity-controlled type scroll compressor having a valve mechanism for opening and closing a bypass hole, there has been a configuration as disclosed in Japanese Laid-Open Patent Application No. Hei 4-179886, for example, in which a bypass hole is defined on an end plate of a fixed scroll, and a capacity control block incorporating a bypass passage enabling the bypass hole to communicate with a suction chamber formed inside the housing and a valve mechanism for opening and closing the bypass passage is constituted as a unit separate from the fixed scroll so that a high pressure introduced from a discharge cavity can be supplied to a control valve for regulating the control pressure of the valve mechanism for opening and closing the bypass hole.

As another example, there is a system as disclosed in Japanese Laid-Open Patent Application No. Hei 5-280476, in which a cylinder is provided in a fixed scroll member, into which a plunger which is capable of sequentially closing a group of bypass holes communicating between the cylinder and the compression chamber is inserted, and in which a high pressure to be supplied to a control valve for controlling the control pressure for reciprocating the plunger is introduced from nearby the front end of the innermost periphery of a vane formed on the fixed scroll.

However, in the above-described prior art configuration, as the high pressure to be supplied to the control valve is introduced from a discharge cavity, when the compressor is restarted under a state of a high discharge pressure, the high discharge pressure is applied to the control valve and the valve mechanism causing the bypass holes closed. Consequently, the compressor is started at a maximum capacity thus suffering from a large shock. On the other hand, in the latter example, although the high pressure to be supplied to the control valve is introduced from nearby the front end of the innermost periphery of the vane formed on the fixed scroll member, the configuration and machining of the lead-in passage are extremely difficult.

DISCLOSURE OF THE INVENTION

In the view of the above described shortcomings of the prior art, it is an object of the present invention to provide a capacity-controlled scroll compressor in which the start shock is reduced and the machinability of the fixed end plate is improved.

In order to attain the above object, the present invention provides inside a fixed end plate a control-pressure chamber which houses a control valve for controlling the controlling pressure for reciprocating a shuttle valve and a high pressure passage opening in the control chamber for introducing a high pressure to the control valve, the other end of the high pressure passage being open at a discharge hole, thereby realizing reduction of the start shock of the compressor with a simple passage structure.

Also, by forming one of the bypass holes communicating with a fluid pocket on the side wall of the discharge hole such that the bypass hole communicates with a cylinder with a straight through-hole from the outer peripheral end of the fixed end plate, or making the cylinder, the bypass hole, and the high pressure passage communicate with a straight through-hole from the outer peripheral end of the fixed end plate, it is possible to reduce the start shock of the compressor as well as to improve the machinability of the fixed end plate.

In other words, the scroll compressor of the present invention is one in which a high pressure is introduced through a passage opening at a discharge hole to a control valve for controlling the control pressure for opening and closing bypass holes with a shuttle valve.

By employing this structure, as a high pressure is instantaneously reduced to a low pressure immediately after a compressor operation has stopped, the control pressure acting on a shuttle valve is also reduced to a low pressure and the shuttle valve comes to state of opening the bypass holes. As a result, when the compressor is restarted, the start shock can be reduced as the compressor is always started at a minimum capacity. Also, the structure of the high pressure passage can be made simpler as the control-pressure chamber and the discharge hole can be made closer to each other.

The other embodiments of the present invention have one of the bypass holes formed on the side wall of the discharge hole and the bypass hole and the cylinder are made to communicate with a straight through-hole from the outer peripheral end of the fixed end plate, or the cylinder, the bypass hole formed on the side wall of the discharge hole and a high pressure passage opening at the discharge hole and introducing a high pressure to the control-pressure chamber are made to communicate with a straight through-hole from the outer peripheral end of the fixed end plate.

According to this structure, it is possible to reduce the start shock as well as to facilitate the simultaneous machining of the individual communicating holes and the passage of the fixed end plate thereby improving machinability.

BRIEF DESCRIPTION OF THE DRAWINGS

The objects and features of the present invention will be best understood by reference to the accompanying drawings wherein.

DESCRIPTION OF THE PREFERRED EMBODIMENTS

Figure 1:
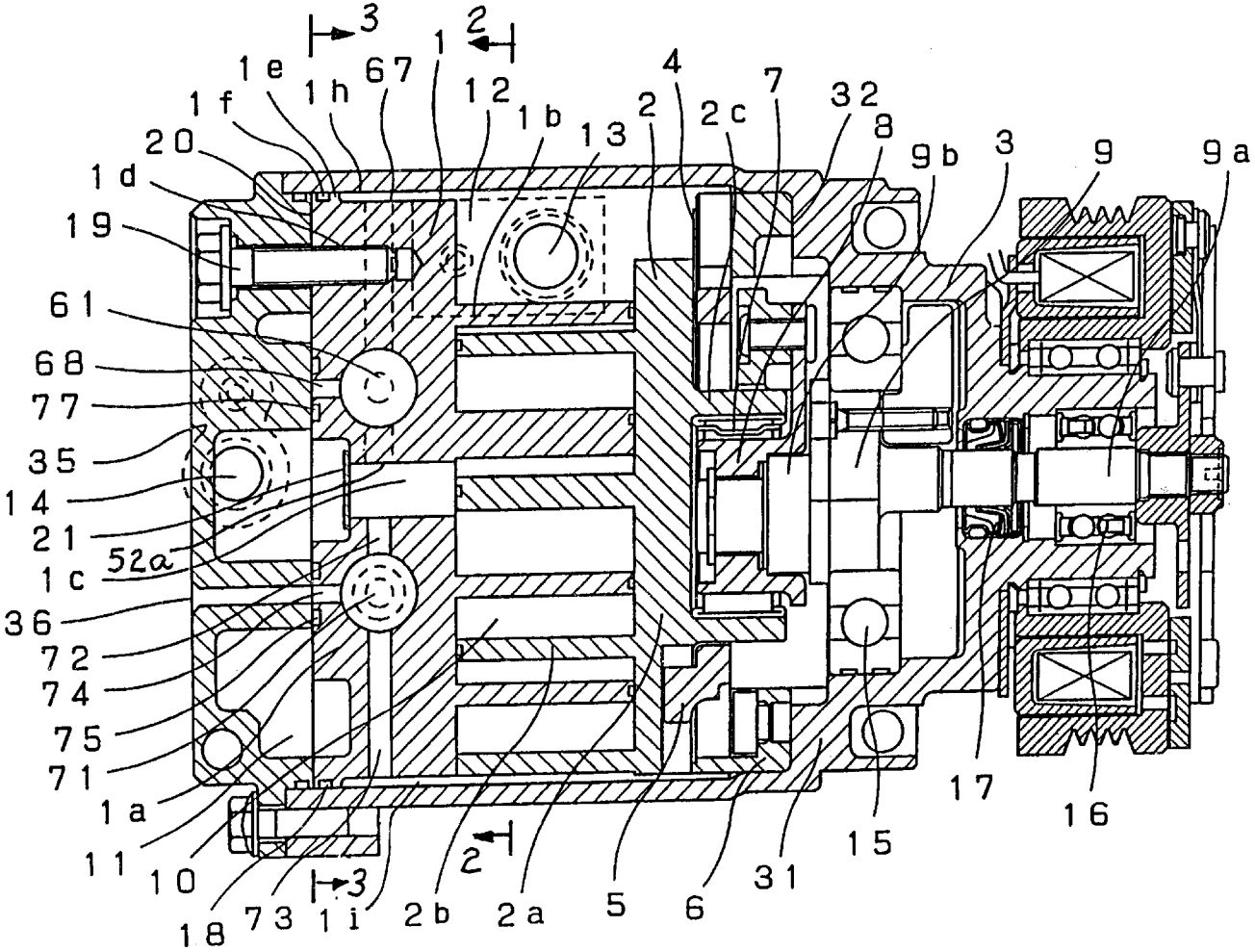
FIG. 1 is a partially in phantom sectional view of a capacity-controlled scroll compressor in a preferred embodiment of the present invention.

Referring to FIG. 1, the basic construction of preferred embodiment of the compressor of the present invention will be described as follows:

In FIG. 1, a compressor housing 3 is divided into a front housing 31 and a rear plate 35, and includes therein a fixed scroll 1 having a fixed end plate 1*a* and a spiral wrap 1*b* erecting or upstanding from fixed end plate 1*a,* and an orbiting scroll 2 having an orbiting end plate 2*a* and a spiral wrap 2*b* erecting or upstanding from orbiting end plate 2*a* and engaged with fixed scroll 1 with both wraps 1*b* and 2*b* facing inward and intermeshed as shown. To provide an orbiting mechanism, a cylindrical boss 2*c* is formed on the rear side of the orbiting end plate 2*a* on the opposite side of the spiral wrap 2*b* of orbiting scroll 2, and an orbiting bearing 7 is provided on boss 2*c*. A drive shaft 9 is rotatably supported via a main bearing 15 fitted in front housing 31, and a main shaft portion 9*a* projects outside of front housing 31 passing through a shaft sealing device 17 and a subsidiary bearing 16. A drive pin 9*b* disposed at the end of drive shaft 9 on the orbiting scroll 2 side is coupled with an orbiting bush 8 functioning as a drive transmission mechanism inserted in orbiting bearing 7, and gives an orbiting motion to orbiting scroll 2 by transmitting the driving force from drive shaft 9. A flat plate thrust bearing 4 is provided between orbiting end plate 2*a* and front housing 31, for directing the axially thrust exerted on orbiting scroll 2 in parallel to orbiting end plate 2*a*. A motion restricting component 6 is provided for restricting the motion of an Oldham ring 5 which restricts the movement of the orbiting scroll 2 so as to permit it to only make an orbiting motion at right angles to drive shaft 9.

An O-ring 18 is inserted in a sealing groove 1*f* on the outer peripheral portion 1*e* of fixed end plate 1*a* of fixed scroll 1 and functions as a sealing member for partitioning the interior of compressor housing 3 into a high pressure chamber 11 and a low pressure chamber 12. Fixed scroll 1 and the rear plate 35 form the high pressure chamber 11. They are assembled by a bolt 19 through the fastening hole 1*d* provided on the rear side of fixed end plate 1*a*. The high pressure chamber has a discharge port 14.

Revolution restraining component 6 is secured on a front end portion 32 inside the front housing 31. The front housing 31 has a suction port 13. The orbiting scroll 2 is pressed against the revolution restraining component 6 by the thrust force via thrust bearing 4. Front housing 31 is closed by rear plate 35 in the vicinity of the outer circumference of fixed end plate 1*a* of fixed scroll 1. A thrust clearance adjusting shim 20 is interposed between the front housing 31 and the rear plate 35 to adjust thrust clearance.

As a result of the orbiting motion of orbiting scroll 2, the refrigerant is introduced from outside of compressor housing 3 into the interior low pressure chamber 12 through suction port 13 and led to the vicinities of the outer peripheries of wrap 1*b* and wrap 2*b* of fixed scroll 1 and orbiting scroll 2, respectively. The refrigerant is then sucked into a fluid pocket 10 formed by and enclosed between both wraps 1*b* and 2*b* by an orbiting motion of orbiting scroll 2, compressed into a smaller volume as it goes from the outer peripheries of both wraps 1*b* and 2*b* toward the center, and is discharged into high pressure chamber 11 through a gas discharge hole 1*c* in the fixed end plate 1*a*. A reed valve or discharge valve 21 is fitted on discharge hole 1*c* from the high pressure side of chamber 11 to prevent the back flow of the discharged gas.

Figure 2:
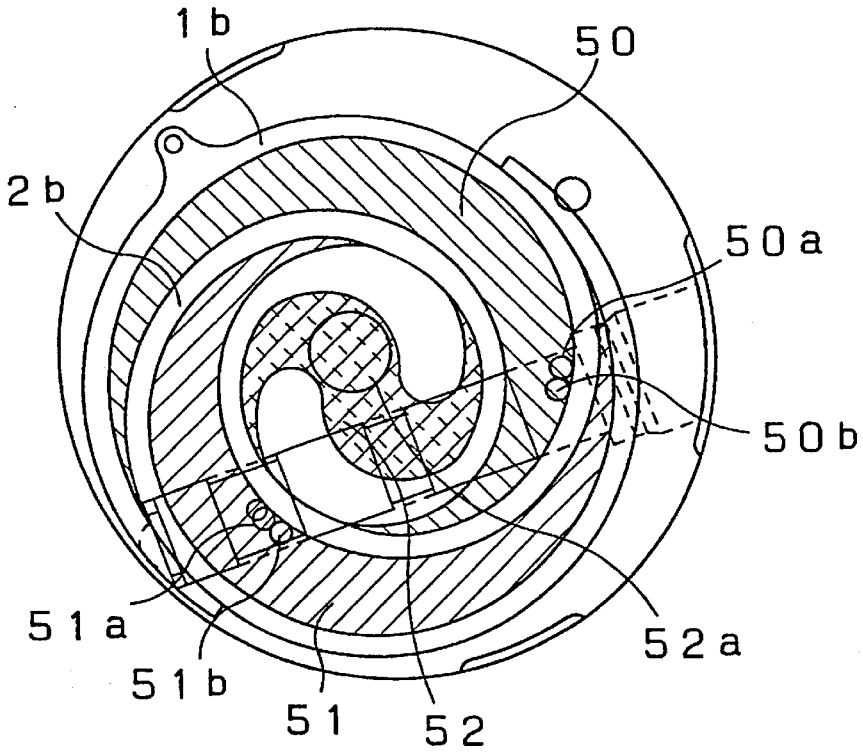
FIG. 2 is a partially in phantom sectional view of a fixed end plate thereof taken along the line 2—2 in FIG. 1.
Figure 3:
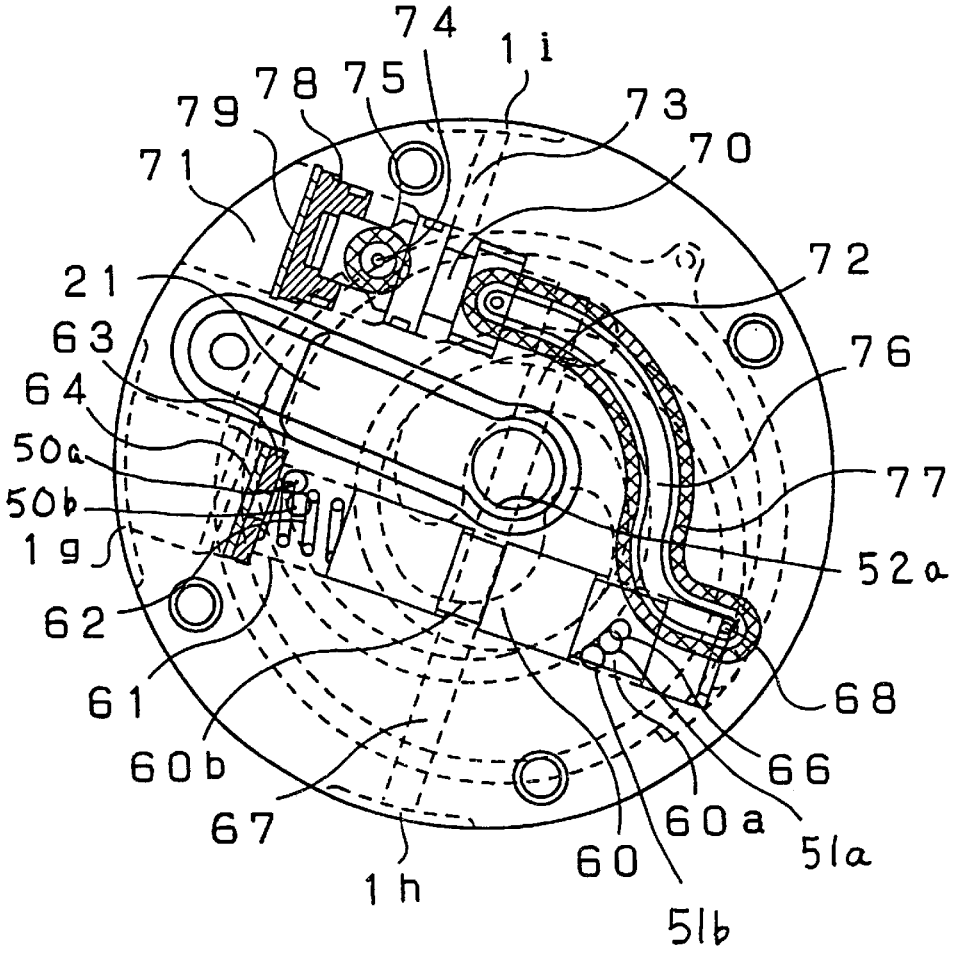
FIG. 3 is a partially in phantom transverse sectional view of a compression chamber of the compressor taken along line 3—3 in FIG. 1.

Referring now to FIGS. 2 and 3, the construction of the capacity controlled mechanism will be described. Generally, a shuttle valve 60 cooperates with a plurality of bypass holes to partially relieve the pressure in the compressor to vary its capacity and to reduce the starting shock of the compressor using a simple bypass construction.

In fixed end plate 1*a,* two pairs of bypass holes 50*a,* 50*b* and 51*a,* 51*b* are provided, each pair respectively communicating with each of a pair of fluid pockets 50 and 51 which are in the same compression process, and a bypass hole 52*a* is provided on the side wall of the discharge hole or discharge port 1*c* which communicates with the region in which the pair of fluid pockets merge into one fluid pocket 52 as the compression process further proceeds.

A shuttle valve 60 is slidably inserted in a cylinder cut out 61 inside fixed end plate 1*a*. Shuttle valve 60 sequentially closes the bypass holes 50*a,* 50*b,* 51*a,* 51*b* and 52*a*. As best shown in FIG. 3, one end of cylinder cut out 61 is open at a cut-away portion 1*g* formed on the outer peripheral portion 1*e* of fixed end plate 1*a* and communicates with low pressure chamber 12. Shuttle valve 60 is pushed by the compressive force of the spring 62 in the leading end direction. The outer end of spring 62 is retained within fixed end plate 1*a* by a holder 63 and a stop ring 64.

Shuttle valve 60 has two recessed portions 60*a* and 60*b* on its outer cylindrical surface. Recessed portion 60*a* is provided at a position at which it communicates with bypass holes 51*a* and 51*b* at the time shuttle valve 60 is in the state of being pushed in the leading end direction (i.e., when spring 62 is extended). Similarly, recessed portion 60*b* is provided at a position at which it communicates with bypass hole 52*a*. Furthermore, a communicating hole 66 is drilled on recessed portion 60*a* allowing communication with low pressure chamber 12 through the interior of shuttle valve 60. The third recessed portion 60*b* communicates with low pressure chamber 12 through a passage 67 passing through fixed end plate 1*a* and cut-away portion 1*h* formed on outer peripheral portion 1*e* of the fixed end plate.

A lead-in hole 68 is drilled at the leading end of cylinder cut out 61 to allow introduction of a control pressure Pm which makes shuttle valve 60 operable by overcoming the compressive or pushing force of spring 62.

On the other hand, a pressure control valve 70 for controlling the control pressure Pm is incorporated in a control-pressure chamber 71 inside fixed end plate 1*a*. The pressure control valve 70 is held by a holder 78 and a stop ring 79.

Control-pressure chamber 71 communicates with a high pressure passage 72 for taking in a high pressure Ph and a flow-out hole 73. As best shown in FIG. 1, high pressure passage 72 communicates with discharge hole 1*c*. Flow-out hole 73 communicates with low pressure chamber 12 via a cut-away portion 1*i* formed on the outer peripheral portion 1*e* of fixed end plate 1*a*. The flow-out hole 73 also serves as a passage for taking in suction pressure Ps as a low pressure signal. Also, a communicating hole 74 for taking in atmospheric pressure Pa to be used as a base signal is drilled on the rear side of fixed end plate 1*a* and is open to the air through a hole 36 drilled on an O-ring 75 and rear plate 35.

Pressure control valve 70 generates an adequate control pressure Pm in response to changes in the high pressure Ph and the suction pressure Ps. The control pressure Pm is transmitted to cylinder 61 through passage 76 formed on the rear side of fixed end plate 1*a* and the earlier-mentioned lead-in hole 68. Passage 76 is sealed by the rear plate 35 and O-ring 77. In operation, one side of the pressure control valve 70 communicates with the atmospheric pressure Pa or base pressure through communicating hole 74. The other side communicates with suction pressure Ps through flow-out hole 73. Thus, the control valve 70 will move responsive to the difference between Ps and Pa. High pressure passage 72 communicates between the discharge hole 1*c* and the control pressure chamber 71 and the fluid pressure in high pressure passage 72 is controlled by the movement of control valve 70. The pressure control valve 70 either allows the high pressure fluid to pass through the flow-out hole 73 into the compressor housing or prevents the flow-out causing the high pressure fluid to be directed into passage 76 to supply the control pressure Pm. Specifically, when the suction pressure Ps is higher than the atmospheric pressure Pa the control valve 70 moves preventing the compressed fluid in the high pressure passage from flowing out of the flow-out hole 73 thereby increasing the control pressure Pm. The increased control pressure then passes through passage 76 through lead-in hole 68 into the cylinder 61 causing shuttle valve 60 to move by compressing spring 62 and closing bypass holes 51*a,* 51*b,* 50*a,* 50*b* and 52*a.*

Conversely, when the cooling load is low, the suction pressure Ps is likewise low causing the control valve 70 to move to the position shown in FIG. 3 opening the passage between the high pressure passage 72 and the flow-out hole 73 in the control pressure chamber 71. Thus, the control pressure Pm communicating with the shuttle valve 60 through passage 76 and lead in hole 68 is reduced enabling spring 62 to overcome the control pressure Pm and move the shuttle valve 60 to the position shown in FIG. 3 wherein the bypass holes 51*a,* 51*b,* 50*a,* 50*b,* and 52*a* are open.

Figure 4:
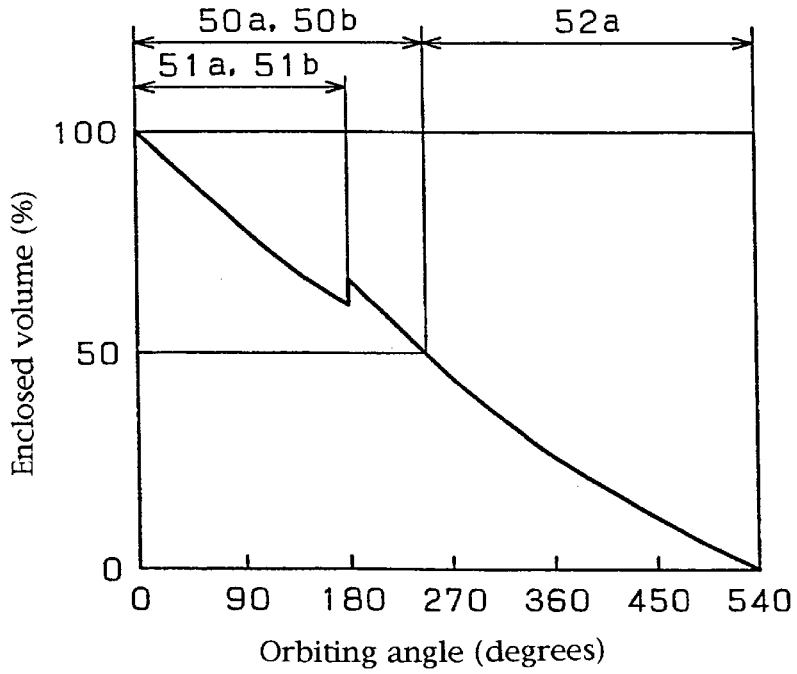
FIG. 4 is a graphical diagram showing the relationship between the orbiting angle and the enclosed volume of the compressor.

Operation of the capacity control mechanism will now be described with reference to FIGS. 4 and 5.

When shuttle valve 60 is at its uppermost position (in the leading end direction of the cylinder) (i.e., when spring 62 is extended as shown in FIG. 3), all the bypass holes are fully open and the operation will be at a minimum capacity. Conversely, when shuttle valve 60 is at its lowermost position (on the holder side) (i.e., when spring 62 is compressed), all the bypass holes are fully closed and the operation will be at a maximum capacity. As can be seen in FIG. 4, bypass holes 51*a* and 51*b* communicate with the fluid pockets up to 100% to about 60% of the region of the maximum compressed volume Vmax. Likewise, bypass holes 50*a* and 50*b* communicate with 100% to about 50%, and bypass hole 52*a* communicates with about 60% to about 0% of the region. By adjusting the openings of these bypass holes with the shuttle valve, the controlled capacity (Vc) vs. shuttle valve stroke (Ls) relationship as shown in FIG. 5 can be obtained.

Figure 5:
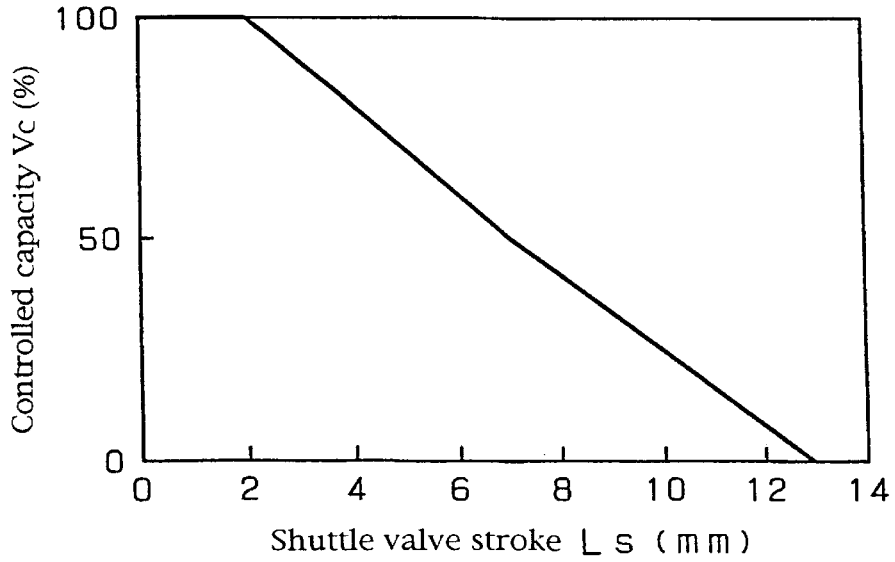
FIG. 5 is a graphical diagram showing the relationship between the shuttle valve stroke and controlled capacity of the compressor.

In FIG. 5, the controlled capacity Vc (on the ordinate axis) represents the percentage ratio of the enclosed volume under control to the maximum enclosed volume of the compressor. Ls=0 (mm) (on the abscissa axis) represents the position of the shuttle valve in the state in which the shuttle valve is at the lowermost position or the position in which the spring 62 is most compressed.

In the range from Ls=0 (mm) to Ls=7 (mm), the shuttle valve 60 has moved to various positions so that bypass holes 50*a,* 51*a,* 50*b,* and 51*b* are opened sequentially and the capacity of the compressor decreases to about 50%.

Beyond Ls=7 (mm), bypass hole 52*a* opens and when shuttle valve 60 reaches the uppermost position [Ls=13 (mm)] wherein the spring 62 is fully extended, the operation will be at about 0% of the capacity.

As has been described earlier, bypass hole 52*a* has an independent bypass passage 67 thus preventing back flow of a bypass gas into bypass holes 50*a,* 51*a,* 50*b* and 51*b* on the downstream side thereby enabling capacity control without reducing the control efficiency.

To more fully understand the operation of the scroll compressor of the present invention, a description of the operation of shuttle valve 60 will be given by using the following symbols:

spring constant of spring 62: k;

initial flection of spring 62: X0;

maximum stroke of shuttle valve 60: X1 (=13 mm); and cross-sectional area of cylinder 61: Sv.

The forces acting on shuttle valve 60 can be obtained by the following equations:

The force Fp with which control pressure Pm moves shuttle valve 60 downward (against the action of the spring 62 is:

$$FP=(Pm-Ps)\times Sv.$$

The force Fs with which spring 62 moves shuttle valve 60 upward is:

$$Fs=k\times(X0+X1-Ls).$$

From the above equations, the spring force Fs0 acting on shuttle valve 60 when shuttle valve 60 is at the lowermost position (Ls=0) is calculated to be:

$$Fs0=k\times(X0+X1).$$

The spring force Fs1 acting on shuttle valve 60 when shuttle valve 60 is at the uppermost position (Ls=X1) is calculated to be:

$$Fs1=k\times X0.$$

Consequently, at the time of operation at the maximum capacity, Fp≧Fs0, the force exerted on the shuttle valve 60 by the control pressure is greater that the force exerted by the spring causing the shuttle valve 60 to move to the lowermost position. Conversely, at the time of operation at the minimum capacity, Fp≦Fs1 allowing the spring 62 to move shuttle valve 60 to the uppermost position. Also, at the time of controlled capacity operation, Fp=Fs and the shuttle valve 60 is balanced at an intermediate position.

Figure 6:
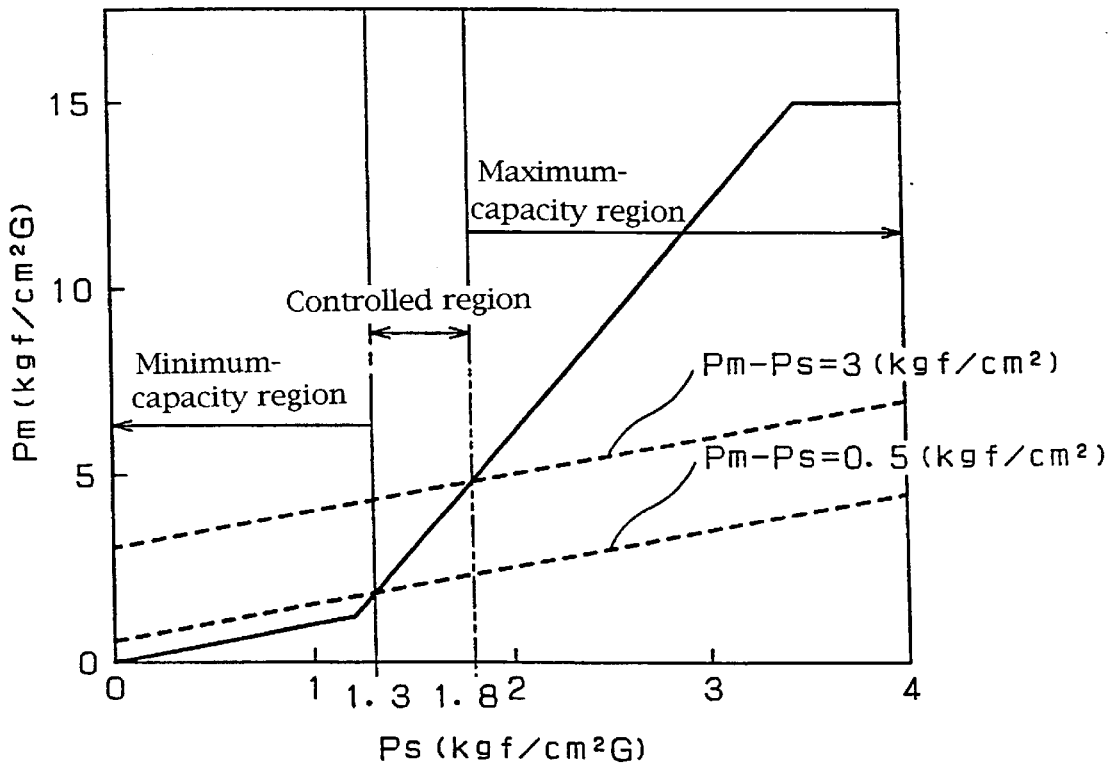
FIG. 6 is a graphical diagram showing the pressure characteristics of the pressure control valve of the compressor of the present invention at different cooling loads.

The pressure characteristics (Pm vs. Ps characteristics) of pressure control valve 70 of the compressor of an exemplary embodiment of the present invention are illustrated in FIG. 6. For example, when the high pressure Ph is 15 kgf/cm$^2$, the load characteristics of spring 62 are designed as below:

$$Fs0/Sv=3.0\ \text{kgf/cm}^2,$$

$$Fs1/Sv=0.5\ \text{kgf/cm}^2.$$

When the cooling load is high, the suction pressure Ps rises resulting in a rise in the control pressure Pm. As represented in FIG. 6, when the suction pressure, Ps is equal to or greater than 1.8 kgf/cm$^2$ the difference between the control pressure and the suction pressure will be equal to or greater than 3 kgf/cm$^2$, $$(Pm-Ps\geqq 3\ \text{kgf/cm}^2(=Fs0/Sv))$$

resulting in force Fp due to control pressure equaling or exceeding the spring force Fp (Fp≧Fs0), and thus the shuttle valve 60 is pushed down to the lowermost position where the spring 62 is compressed. Thus, the bypass holes 50*a,* 51*a,* 50*b,* 51*b* and 52 will be closed causing the compressor to operate at the maximum capacity increasing the cooling capacity.

Conversely, when the cooling load is low, the suction pressure Ps drops resulting in a drop in the control pressure Pm. When the suction pressure Ps drops to 1.3 kgf/cm$^2$ or less the force due to the control pressure (Fp) is less than or equal to the force from the partially compressed spring (Fs1) (Fp≦Fs1) and shuttle valve 60 is pushed up to the uppermost position (by the force of the spring 62) causing the compressor to operate at the minimum capacity decreasing the cooling capacity. The Ps range of 1.8 kgf/cm$^2$<Ps<1.3 kgf/cm$^2$ is the range of controlled operation in which the control mechanism can stabilize the suction pressure Ps at an optimum value for the cooling load.

The pressure control valve 70 of the present invention also reduces the starting shock. When the compressor stops the high pressure Ph drops accompanying a drop in the control pressure Pm resulting in Pm being nearly equal to Ps. Fp becomes nearly equal to zero kgf/cm$^2$ allowing the spring 62 to push shuttle valve 60 upward thereby opening all the bypass holes 50*a,* 51*a,* 50*b,* 51*b* and 52*a.* Thus, when the operation is subsequently restarted, the compressor starts from the minimum capacity thus relieving the start shock and assuring a smooth start-up.

Industrial Application

As is clear from the above-described exemplary embodiment, the capacity-controlled scroll compressor of the present invention, has a reduced start shock as the high pressure which works as the control pressure of a shuttle valve for opening and closing bypass holes is introduced from a high pressure passage opening at a discharge hole. When the compressor stops, the pressure in the area of the discharge hole reduces immediately, thereby reducing the control pressure which controls the movement of the shuttle valve 60. The reduced control pressure enables the spring 62 to cause the shuttle valve 60 to move to the uppermost position (i.e., the position where spring 62 is most extended) opening the bypass holes 50*a,* 51*a,* 50*b,* 51*b* and 52*a* so the compressor is generating at the minimum capacity. Once the compressor starts, the control pressure increases causing the shuttle valve 60 to compress spring 62 and move towards the lowermost position gradually increasing the capacity of the compressor.

Also, the present invention enhances manufacture of the compressor by employing a configuration in which one of the bypass holes 52*a* is formed on the side wall of the discharge hole 1*c* so that the simultaneous machining of the bypass hole 52*a* and a passage 67 (that communicates with the bypass hole 52*a* and the cylinder 61) can be performed from the outer peripheral end of a fixed end plate. Thus, it is possible to improve the machinability of the fixed end plate.

Furthermore, the compressor of the present invention further employs a configuration in which the high pressure passage 72 is coaxial to the low pressure passage 67 (see FIGS. 1 and 3) so that passages 67, 72 and bypass hole 52*a* in the side wall of the discharge hole 1*c* can be simultaneously machined from cut out 1*h* in the outer peripheral end of the fixed end plate.

Thus, the present invention provides an improved variable capacity scroll compressor that incorporates control structure in the fixed end plate which makes it possible to reduce the start shock while providing a compressor having a fixed end plate with superior machinability.

The present invention has been shown and described in what is considered to be the most practical and preferred embodiment. It is anticipated, however, that departures may be made therefrom and that obvious modifications will occur to persons skilled in the art.

We claim:

1. In a capacity-controlled scroll compressor comprising; a compressor housing; a fixed scroll having a fixed end plate and a spiral wrap extending from said fixed end plate; an orbiting scroll having an orbiting end plate and a spiral wrap extending from said orbiting end plate and disposed in engagement with said fixed scroll with respective wraps facing each other; said wraps of said fixed scroll and said orbiting scroll intermeshed to define a plurality of fluid compression pockets and positioned to receive fluid to be compressed from a suction chamber in said housing, said fixed scroll and said orbiting scroll being disposed inside of said compressor housing; an orbiting mechanism formed on the rear side of said orbiting end plate opposite the spiral wrap of said orbiting scroll; a drive shaft rotatably supported in said compressor housing with the main shaft portion thereof projecting to outside of said compressor housing passing through a shaft sealing device and a subsidiary bearing through a main bearing; a drive transmission mechanism for transmitting the driving force from said drive shaft to said orbiting mechanism; a rotation restraining component for restraining rotation of said orbiting scroll as to make it orbit; a revolution restraining component adjacent to said rotation restraining component for restraining the direction of motion of said rotation restraining component to the direction at right angles to said drive shaft; a discharge port formed in said fixed end plate communicating with the fluid compression pocket near the end of its formation; and a discharge valve at the end of said discharge port;

an improved capacity control mechanism comprising:

at least a pair of bypass holes in said fixed end plate communicating with a pair of fluid compression pockets formed in between both wraps at positions substantially symmetrical with respect to said fixed end plate;

a cylinder formed inside said fixed end plate in a manner communicating with said pairs of fluid pockets through said bypass holes;

a shuttle valve inside said cylinder mounted for reciprocal motion therein to vary the opening of said bypass holes to change the capacity of said compressor;

a spring in said cylinder opposing reciprocation of said shuttle valve;

a fixed end plate further including a control-pressure chamber housing a pressure control valve for generating a control pressure for causing the reciprocation of said shuttle valve against said spring responsive to said control pressure; and a high pressure passage in said fixed end plate between said control-pressure chamber and said discharge port of said fixed end plate located before said discharge valve for introducing said compressed fluid at relatively high pressure to said pressure control valve wherein said pressure control valve generates a control pressure from said relatively high pressure fluid responsive to pressure in said compressor housing.

2. The capacity-controlled scroll compressor of claim 1, further including a bypass hole formed on the side wall of the discharge port and a passage between said bypass hole and said cylinder, whereby said compressed fluid at relatively high pressure is directed to said shuttle valve through said passage and the reciprocation of said shuttle valve responsive to said control pressure selectively varies the output of said compressor.

3. The capacity-controlled scroll compressor of claim 2, wherein said passage between said bypass hole and said shuttle valve is substantially coaxial with said bypass hole on the sidewall of said discharge port.

4. The capacity-controlled scroll compressor of claim 3, wherein said fixed end plate further includes a low pressure passage communicating with said cylinder and providing a passageway from said cylinder to the outer peripheral surface of said fixed end plate.

5. The capacity-controlled scroll compressor of claim 4, wherein said low pressure passage is coaxial with said passage between said bypass hole in said cylinder.

6. The capacity-controlled scroll compressor of claim 5, wherein said low pressure passage, said bypass hole and said passage between said bypass hole and said cylinder are coaxial and accessible from said outer peripheral surface of said fixed end plate.

7. The capacity-controlled scroll compressor of claim 2, wherein said at least a pair of bypass holes and said bypass hole formed on the sidewall of the discharge port selectively communicate with the low pressure area of said compressor through separate passages responsive to said control pressure.

8. In a capacity-controlled scroll compressor comprising: a compressor housing; a fixed scroll having a fixed end plate and a spiral wrap extending from said fixed end plate; an orbiting scroll having an orbiting end plate and a spiral wrap extending from said orbiting end plate and disposed in engagement with said fixed scroll with respective wraps facing each other; said wraps of said fixed scroll and said orbiting scroll intermeshed to define a plurality of fluid compression pockets and positioned to receive fluid to be compressed from a suction chamber in said housing, said fixed scroll and said orbiting scroll being disposed inside of said compressor housing; an orbiting mechanism formed on the rear side of said orbiting end plate opposite the spiral wrap of said orbiting scroll; a drive shaft rotatably supported in said compressor housing with the main shaft portion thereof projecting to outside of said compressor housing passing through a shaft sealing device and a subsidiary bearing through a main bearing; a drive transmission mechanism for transmitting the driving force from said drive shaft to said orbiting mechanism; a rotation restraining component for restraining rotation of said orbiting scroll as to make it orbit; a revolution restraining component adjacent to said rotation restraining component for restraining the direction of motion of said rotation restraining component to the direction at right angles to said drive shaft; a discharge port formed in said fixed end plate communicating with the fluid compression pocket near the end of its formation; and a discharge valve at the end of said discharge port;

an improved capacity control mechanism comprising:

at least a pair of bypass holes in said fixed end plate communicating with a pair of fluid compression pockets formed in between both wraps at positions substantially symmetrical with respect to said fixed end plate;

a cylinder formed inside said fixed end plate in a manner communicating with said pairs of fluid pockets through said bypass holes;

a shuttle valve inside said cylinder mounted for reciprocal motion therein to vary the opening of said bypass holes to change the capacity of said compressor;

a spring in said cylinder opposing reciprocation of said shuttle valve;

a fixed end plate further including a control-pressure chamber housing a pressure control valve for generating a control pressure for causing the reciprocation of said shuttle valve against said spring responsive to said control pressure;

a high pressure passage in said fixed end plate between said control-pressure chamber and said discharge port of said fixed end plate located before said discharge valve for introducing said compressed fluid at high pressure to said pressure control valve wherein said pressure control valve generates a control pressure from said high pressure fluid responsive to pressure in said compressor housing;

a bypass hole formed on the side wall of said discharge port and a passage between said bypass hole and said cylinder wherein said high pressure fluid is directed to said shuttle valve through said passage; and a low pressure passage communicating with said cylinder and providing a passageway from said shuttle valve to the outer peripheral surface of said fixed end plate wherein said bypass hole, said passage between said bypass hole and said cylinder and said low pressure passage are substantially axially aligned and accessible from said outer peripheral surface of said fixed end plate.

* * * * *